US005509256A

United States Patent [19]

Groth

[11] Patent Number: 5,509,256

[45] Date of Patent: Apr. 23, 1996

[54] FIBROUS MATERIAL PACKAGING MACHINE

[76] Inventor: Ernest F. Groth, 285 E. Rutherford Rd., Brawley, Calif. 92227

[21] Appl. No.: 359,432

[22] Filed: Dec. 20, 1994

Related U.S. Application Data

[63] Continuation-in-part of Ser. No. 267,555, Jun. 29, 1994.

[51] Int. Cl.[6] ..... B65B 63/02; B65B 13/20; B67B 7/46

[52] U.S. Cl. ..... 53/513; 53/529; 53/381.2; 83/701; 83/858; 83/857

[58] Field of Search ..... 83/701, 858, 857, 83/437; 53/513, 168, 381.2, 529, 551; 141/280; 100/4

[56] References Cited

U.S. PATENT DOCUMENTS

| | | | |
|---|---|---|---|
| 2,523,517 | 9/1950 | Potter | 53/168 |
| 3,513,623 | 5/1970 | Pearson | 53/168 |
| 4,447,382 | 5/1984 | Spurlock et al. | 141/280 |
| 4,929,141 | 5/1990 | Keesey et al. | 53/381.2 |
| 5,001,974 | 3/1991 | Gombos | 100/4 |
| 5,088,271 | 2/1992 | Westaway | 53/551 |
| 5,174,088 | 12/1992 | Focke et al. | 53/529 |
| 5,228,372 | 7/1993 | Harrop et al. | 83/701 |
| 5,245,902 | 9/1993 | Pereira | 83/858 |

*Primary Examiner*—Horace M. Culver
*Assistant Examiner*—Rodney A. Butler
*Attorney, Agent, or Firm*—John R. Duncan; Frank D. Gilliam

[57] ABSTRACT

An apparatus for packaging fibrous material in uniform, high density, self supporting, packages. Fibrous materials, such as alfalfa hay, grasses, etc. in the form of bales or loose material, are received. The material is moved through a cutting device, if needed, to form uniform sized portions, the material is formed into a level stream on a conveyor, measured into selected quantities and compressed to form very dense, self supporting packages. Preferably, the packages are inserted into plastic film enclosures for handling and shipping. This material is much more convenient and economical to ship and store than the much larger equivalent weight of loose, uncompacted material. Preferred mechanisms for stripping bands from bales, cutting and milling the received material to a desired size distribution and for weighing and compressing the material are also disclosed.

20 Claims, 5 Drawing Sheets

FIBROUS MATERIAL PACKAGING MACHINE

This is a continuation-in-part of copending application Ser. No. 08/267,555 filed on Jun. 29, 1994.

BACKGROUND OF THE INVENTION

This invention relates in general to machines for packaging fibrous materials, such as alfalfa, and more particular for a machine for separating, weighing, compressing and packaging fibrous materials.

Livestock feed products, such as alfalfa hay, and other fibrous products are generally transported in low density bales bound with binder twine. Because of the low bale density, trucks are generally loaded with very high stacks of bales. Loading and unloading the trucks is difficult and time consuming. Loads may shift, causing roll over accidents. The bales may become wet due to rain during shipment, leading to mildew or rot which may reduce the value of the material or even ruin it for use as an animal feed.

Because of the low density, shipping bales of fibrous materials over long distances is generally not economical. Transporting such material by sea is expensive and difficult, in particular because the low density bales are expensive to handle, load and unload relative to the value of the material. Also, if the material becomes wet or even damp in the presence of oxygen during a long voyage, mildew and rot are likely and spontaneous combustion is possible.

Attempts have been made to compress such fibrous materials to increase the density and make shipment more convenient and economical. Typical of these are the devices described by Jensen in U.S. Pat. No. 4,090,440 and Gombos in U.S. Pat. No. 5,001,974. Bales of hay and the like are compressed by a hydraulic ram to a higher density, then straps are wrapped around the bales and they are shipped. While density is improved, these devices do not assure that the compressed bales are uniform in weight and of an optimally high density. The bales are still susceptible to mildew, rot and the formation of toxins in the material due to existing moisture content or outside moisture, such as rain and the like since oxygen is not excluded.

Prior hay bale compression devices generally compressed a pre-existing bale, of the sort produced by balers in the field, so that the final density is not uniform. Further, the size and uniformity of the fibrous particles are not optimized for the animals to be fed or for other uses of the material. Because of the non-uniform fibrous particles, weighing precise amounts of the material for re-baling with prior devices is difficult or impossible.

A number of different machines for forming plastic bags and filling the bags with a measured amount of a material have been developed. Among these are the machines described by James in U.S. Pat. No. 4,288,965 and Mikata et al. in U.S. Pat. No. 4,813,205. Typically, a web of plastic material is formed into a tube, the tube is sealed along a crosswise line to form a bag, a quantity of a product is dropped into the bag and the inlet is sealed. While effective for many materials for short term storage, this type of bagging machine is not successful with fibrous material which has a significant moisture content and is intended for long distance shipment under varying conditions or for long term storage. Moisture trapped in the bag with organic fibrous material is likely to develop mildew or other deleterious conditions since oxygen is not removed from the bag, making the material unusable for the intended purpose.

Further, these plastic bags are generally pillow-like and difficult to carry, stack or handle, especially where a considerable weight of material is enclosed.

Thus, there is a continuing need for improved machines for packaging fibrous material which overcome the problems of prior devices in providing uniform fiber particles of desired size, in precisely weighing or otherwise measuring selected quantities of material, in fully and uniformly compressing the material into high density packages, of reducing or eliminating retained oxygen and moisture problems in containers for the material and of making the final product convenient to handle.

SUMMARY OF THE INVENTION

The above-noted problems, and others, are overcome in accordance with this invention by a machine for packaging fibrous material which produces a uniform high density package of material packed in a plastic film package. The fibrous material to be packaged, typically alfalfa hay, grasses, beet pulp, whole cotton seed, wood shavings, mixed materials etc., is received at an entering conveyor. If the material is in the form of bales bound by binding twine, plastic straps, etc (as is the usual case) the material is passed though a separation station where twine or other binding bands are removed and directed to a disposal location.

The material is then conveyed to a cutting station where the material is cut to a selected size distribution. Typically, the material may be forced through a die having plural openings, typically in an "eggcrate" configuration of plural crossed cutting edges, by an hydraulic cylinder assembly. If a shredded material is preferred, the milling may be accomplished with a hammer mill or the like. Alternately, where the material is in the form of long fibers which are to be cut to a selected length, a saw assembly may cut the material vertically and/or horizontally.

The material is then conveyed through a flow leveler to maintain a selected flow level or thickness on the main conveyor. Typically, an endless belt having a portion running at an adjustable height above the conveyor has a cleated surface running in the opposite direction to the flow maintains the desired flow level on the conveyor.

If desired, any desired supplement is preferably added to the material just after the flow is leveled. Typical supplements include minerals, vitamins, electrolytes, grain mixes and mixtures thereof.

A cross conveyor then moves material onto a scale to weigh the material. When the scale indicates that a selected quantity of material has reached the scale, the material is dumped into a load chamber. Preferably, two load chambers are provided on two sides of the scale mechanism so that material batches can be dumped into either chamber. The speed of the main conveyor and cross conveyor may be varied as appropriate to enable the scale to weigh accurately with different materials having a wide range of density factors.

The batch of material is moved from a load chamber into a compression chamber where a plunger, preferably hydraulically actuated, applies the selected compression pressure. Typically a batch originally filling 25 cubic feet can be compressed to about 0.98 cubic foot. For most fibrous materials in bales or loosely packed, the volume reduction will be from about 10:1 to 30:1.

While any size packages may be produced, preferably a package with flat, generally parallel top and bottom surface and outwardly rounded side surfaces is preferred. The primary compression is against the top and bottom surfaces, so that the vertical density is higher, permitting stacking to considerable heights. The sides are softer, to permit ease of breaking up the material for use. Typical packages have heights of about 13 inches, with widths of about 12 inches and lengths of about 15 inches.

An eject plunger, preferably hydraulically actuated, then moves the compressed batch, which is generally in the form of a shape retaining unit, to a packaging station where the package is enclosed in plastic film. Any suitable wrapping apparatus and material may be used, as desired. Preferably, a tube is formed on-site from a plastic film roll in a conventional manner. Any suitable plastic may be used. While adhesive sealing could be used, a heat sealable plastic is preferred, such as low stretch polyethylene, which may have a coating of a heat sealing material.

The package of material in the tube is preferably conveyed to a vibration station, where the plastic film areas to be sealed are vibrated to remove dust from the plastic surface to be sealed. Typically, tuckers enter tube ends beyond the material ends to form gussets in the tube ends and seal bars fold over the tube ends. Air is exhausted through mufflers located on the eject chamber. Film relaxers roll over the top center of the package to relax the film for sealing. Heated seal bars then close the ends and seal the overlapping film, producing a closed, air tight package. Removing substantially all oxygen will prevent significant growth of mildew, mold spores and other deleterious organisms in the package. Also, if desired a pesticidal gas may be introduced into the package to kill insects and other vermin.

Carrying handles are then preferably formed in any suitable manner on the enclosed package. Typically, carrying handles or indentations may then heat cut into the package. While any suitable number of handles may be applied, four handles are preferred for ease of handling, moving and stacking of packages.

Eject belts engaging sides of the packages then eject the packages onto conveyor belts which carry the packages to shipping containers, storage areas, etc. as desired.

Preferably, the entire machine for forming the packages of fibrous material is carried on a single truck or large flatbed trailer, together with the power unit supplying electric, air and hydraulic power. The film wrapping station may be mounted on a separate trailer connectable to the main machine support. Typically, two 500 hp diesel engines with associated accessories can power the packaging machine, which typically weighs about 120,000 lbs and is about 13.6 feet high, 51 feet long and 102 inches high.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
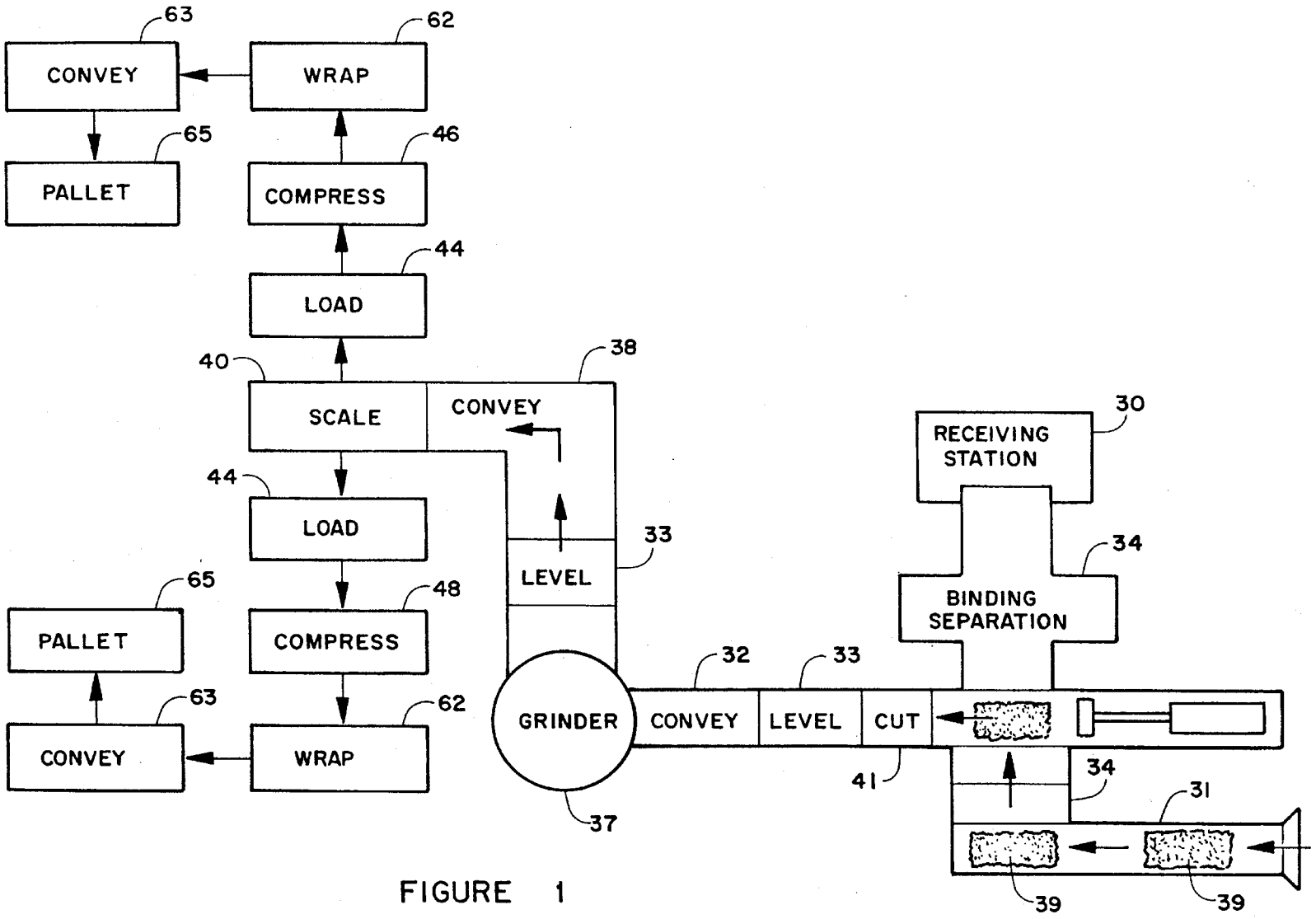
FIG. 1 is a general schematic flow diagram of the packaging machine of this invention.
Figure 2:
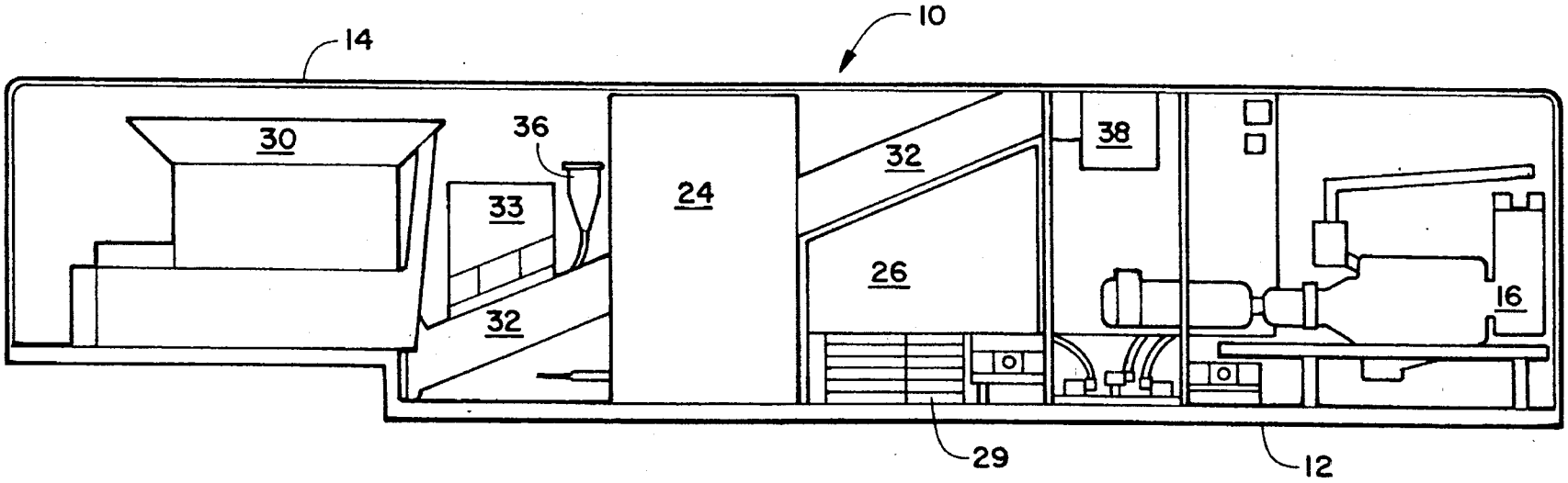
FIG. 2 is a left side elevation view of the packaging machine.
Figure 3:
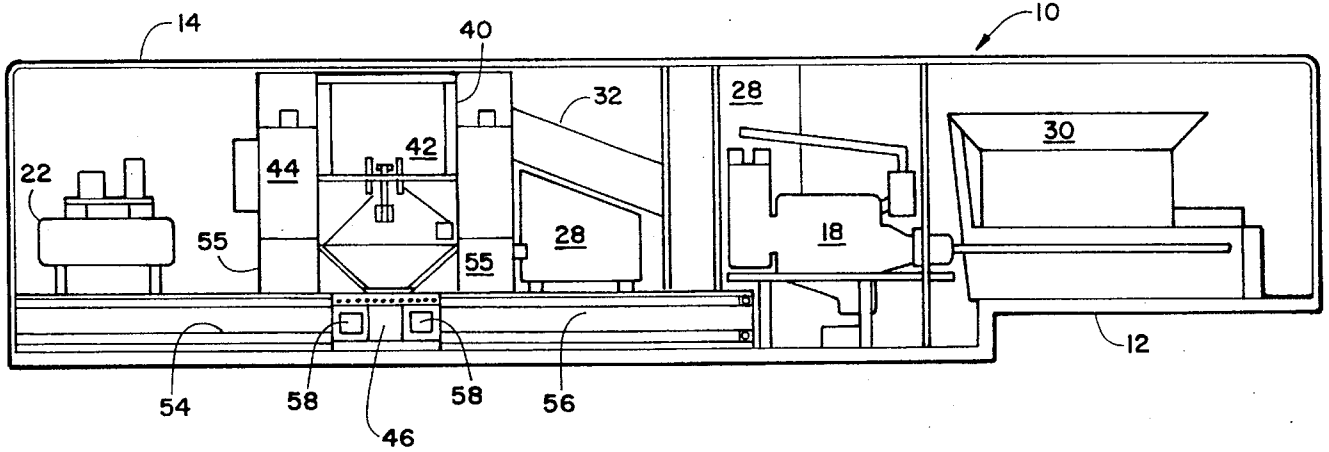
FIG. 3 is a right side elevation of the packaging machine.

Referring to FIGS. 1–3, there is seen schematic representations of the over-all packaging machine from above in FIG. 1 and from the right and left sides in FIGS. 2 and 3. FIG. 1 is a very schematic view illustration the over-all operation of the machine. For clarity, each side view in FIGS. 2 and 3 shows only those components most clearly seen from the respective sides.

As seen in FIGS. 2 and 3 the entire package machine 10 is mounted on a base 12, which preferably is the bed of large truck so that packaging machine 10 can be easily moved to a location where fibrous material to be packaged is produced. An open frame 14 preferably surrounds machine 10 to permit it to be covered if desired, such as with canvas covers, during movement from site to site.

In order to power the various components and provide electricity, hydraulic power and air under pressure at remote sites, two large diesel engines 16 and 18 (as seen in FIGS. 2 and 3, respectively), each typically a Cummings 500 hp engine, are provided. An electrical generator 20, typically an AC-DC generator of the type available from the Lima Company is driven by engine 16. An air compressor 22, typically a rotary screw type compressor of the sort available from Ingersoll Rand provides process air. Hydraulic oil for the various hydraulic systems detailed below is contained in reservoirs 24 and 26 (FIG. 2) and 28 (FIG. 3) with an oil cooler 29.

The material to be packaged, typically bales of hay, loose wood shavings, etc. is placed in open-topped receiving station 30. A conventional electric motor driven conveyor in the bottom of station 30 moves the material to a cutting station, then an inclined conveyor 32. As material moves from the bottom of receiving station 30 toward conveyor 32, it passes through a separation station 34, where twine, straps or the like are removed, as detailed in FIGS. 4 and 5, discussed below. Loose material simply passes through station 34. Alternatively, instead of a bin-like receiving station 30, bales may be received from a truck or the like and deposited onto a conveyor 31 which moves the bales through another twine removal station 34 and delivers them to the cutting station 41. Bales are preferably passed through the cutting station described below. If desired, a conventional hammer mill, a saw arrangement other dividing means may be used if different material forms are desired.

Figure 6A:
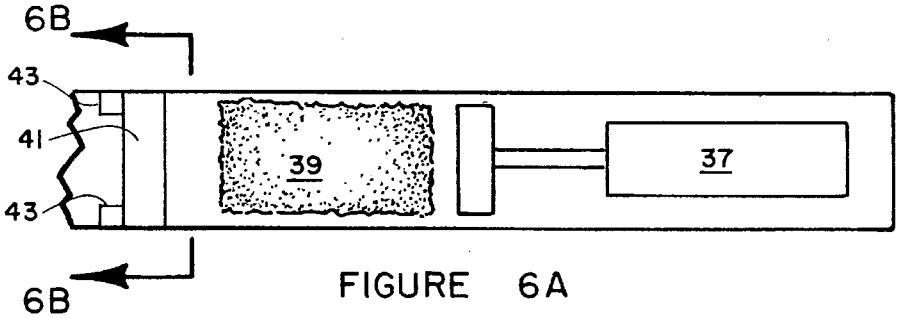
FIG. 6A is a schematic detail side elevation view of the incoming material slicer.
Figure 6B:
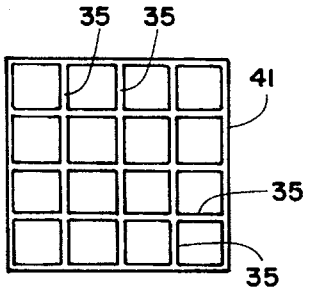
FIG. 6B is a section view taken on line 6B—6B in FIG. 6A, showing the slicer knife pattern.

The material passes through cutting station 41 where the material is cut and/or shredded into selected fiber lengths and textures. Any conventional cutting or shredding device can be used, as desired. The cutter may be sized so that one, two or more bales may be passed through the cutter station in parallel. In one preferred method, a hydraulic cylinder presses the material through an "eggcrate" shaped cutting die as seen in FIGS. 6A and 6B. Typically, the die openings may be from about 2 to 4 inches wide and high. For best results, the cutting die is vibrated during cutting, such as by a conventional mechanical or electrical vibrator 43. The cut material is ejected into conveyor 32 which levels the cut material and conveys it to the weighing station. A schematic representation of the operation of the leveling conveyor is provided in FIG. 7 below.

Next, the material passes under an additive station 36 where an additive comprising agents such as minerals, vitamins, electrolytes, grain mixes, etc. is sprayed or dusted onto the material. Any conventional variable application device, such as a liquid sprayer or powder dispenser, may be used at additive station 36.

As the material reaches the upper end of conveyor 32, the material preferably passes through a conventional tub grinder 37. The material, now reduced in size to the desired degree, is transferred to a cross conveyor 38 which moves the material to the side shown in FIG. 3.

Figure 8:
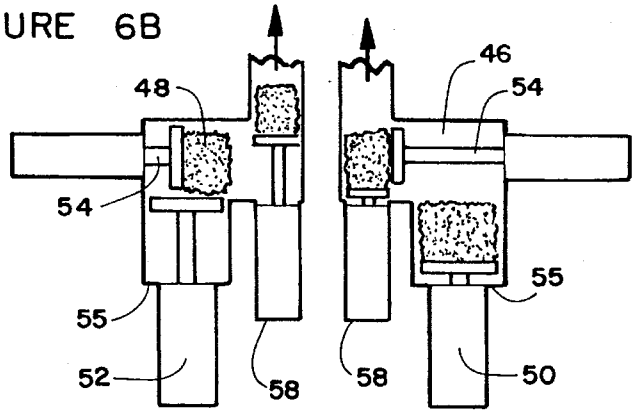
FIG. 8 is a detail plan view of the material compression mechanism.
Figure 9:
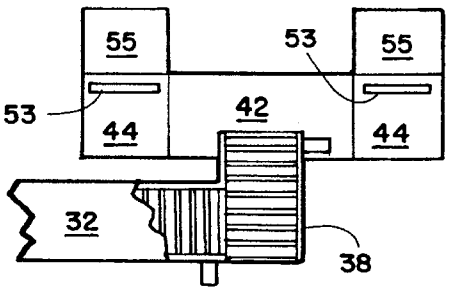
FIG. 9 is a detail plan view of the loading devices that feed the material compression mechanism of FIG. 8.

The material enters a scale and loading tower 40. The material is gradually fed to a conventional scale 42 such as a suspended platform scale of the type available from the Fairbanks Morse Company. When a preselected weight of material is collected on scale 42, the selected quantity of material is dumped into one of two load chambers 44 by tipping the scale platform approximately 45° toward the selected load chamber 44. Movable panels 53 move material into chambers 55. Material in the chambers 55 is moved into compression chambers 46 and 48 by load cylinders 50 and 52, respectively (as best seen in FIGS. 8 and 9).

The material in each load chamber is compressed by the corresponding compression cylinder 54. Finally, the compressed packages of material are ejected by ejection cylinders 58. The compression chambers typically have convex rounded sides so that the package of material, will have flat top and bottom surfaces and outwardly rounded sides. The package will preferably be firmer in the vertical direction, to facility stacking the packages while the lower firmness in the transverse direction will aid in breaking up the package for use.

The compressed packages are passed to the on-line wrapping assembly 62 as described in detail in conjunction with the description of FIG. 7, below. Any suitable wrapping device may be used to form a tube from a continuous plastic web, insert the package of material into the tube. Cut the tube adjacent to the package and seal the tube. Typical such tube forming devices is that described by James in U.S. Pat. No. 4,288,965.

If desired, air can be removed by inserting a thin tube connected to a conventional vacuum pump into the package during sealing, then sealing between the end of the vacuum tube and the package. Also, after removal of air, a pesticidal gas may be admitted into the package to kill insects, mold or the like. A "Y" connection to the vacuum tube can easily be used, with the source of pesticidal gas connected to the tube in place of the vacuum pump.

Once the packages are wrapped, they are conveyed by conveyors 63 to pallets 65 for stacking and shipment. Details of various components of the overall processing and packaging machine are provided in FIGS. 4–11.

Figure 5:
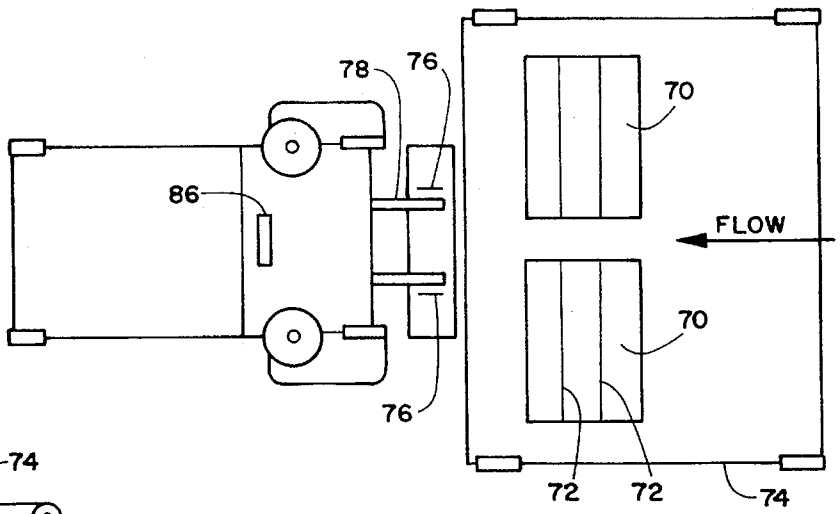
FIG. 5 is a schematic plan view of the device of FIG. 4.
Figure 4:
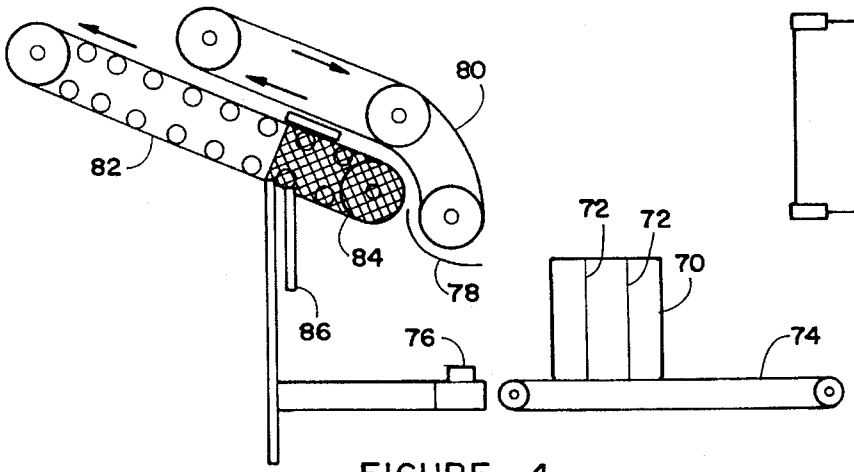
FIG. 4 is a schematic side elevation view of the device for removing bale binding bands.

Details of the automatic band removing station are provided in FIGS. 4 and 5. Bales 70 having bands 72 of twine, plastic straps or the like are moved from receiving station 30 by conventional chain conveyor 72 past upstanding knives 76 that cut bands 72. Pick up rods 78 catch the bands 72 and direct them between two closely spaced endless belts 80 and 82 that carry off the bands to a disposal container (not shown). A steel shroud 84 prevents material, either fibrous material or bands, from becoming entangled in endless belt 82 or the pulleys supporting that band. Each bale is pushed through the twin remover by the next preceding bale. A pressure switch 86 is provided to disengage the hydraulic cylinder 37 that pushed the bales through the twine removal station until the next bale is to be processed. After twine removal, the bales move to the cutting station shown in FIG. 6A.

As schematically shown in FIG. 6A, a hydraulic cylinder 37 pushes the fibrous incoming material 39, typically in the form of a bale, through a sharp edged die 41, having an "eggcrate" like configuration (as seen in FIG. 6B) of plural crossed knife edges 35. The crossed knife blades have cooperating slots half way through the blade with so as to interlock in an eggcrate manner. For example, the vertical blades could be notched from the front and the horizontal blades could be notched from the back. Further, for maximum rigidity, shallow routed channels may be formed extending beyond the notches into which the edges of blades slide beyond the notches to resist twisting forces. Typically, the blade spacing will be about 2 to 4 inches, providing easily handled portions of the material.

Alternatively, if desired the die may be moved toward the bale, which is supported by a stationary hydraulic cylinder plunger. Further, if desired, after the die makes one cut through a bale, the bale can be rotated 90° and cut a second time to produce uniform cubes of material. From the cutting station, the material passes to conveyor 32, as discussed above.

Figure 7:
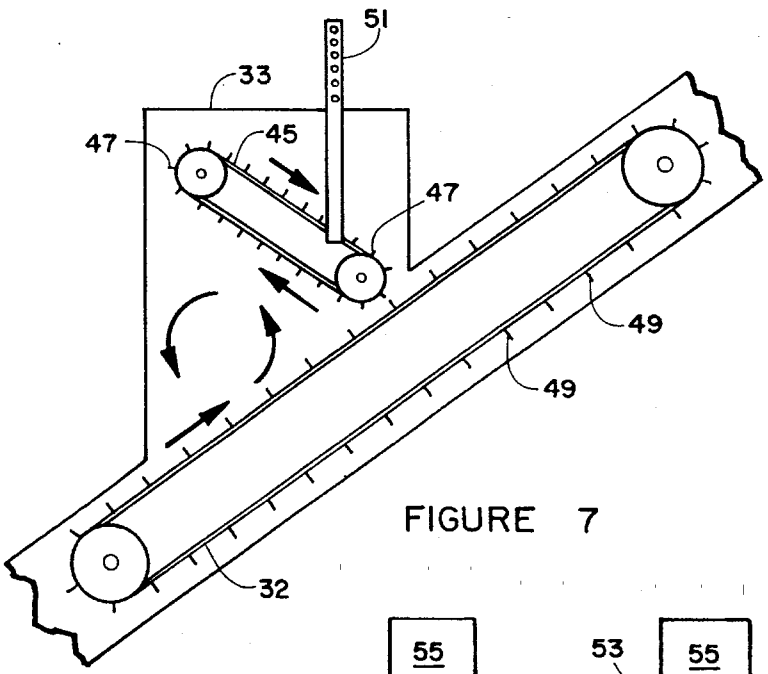
FIG. 7 is a schematic side view of the leveling conveyor fro conveying incoming material to the compression station.

FIG. 7 provides further details of conveyor 32 and the leveling station. As the material begins to move upwardly with inclined conveyor 32, it passes through the leveling station 33 where an endless belt 45, positioned at a selected distance above conveyor 32, carries a series of rubber cleats 47 moving counter-current to conveyor 32. Cleats 47 wipe excess material back toward the lower end of conveyor 32 and maintain a uniform height to the material on conveyor 32 while continuously mixing the material. Conveyor 32 may also have upstanding cleats 49 to prevent material slipping back down the inclined conveyor. Belt 45 may be pivoted about its upper end, so that the lower end may be raised or lowered by flow adjuster 51 to raise or lower the level of material on conveyor 32.

FIGS. 8 and 9 provide further details of the scale and loading systems. Material enters on conveyor 32 and feeds onto cross conveyor 38 that meters material to scale 42, which typically is a suspended platform scale of the sort available from the Fairbanks-Morse Company. When scale 42 has received the selected weight of material, the material is dumped into one of loading towers 44 and then is swept into a chamber 55 by a movable panel 53. Load cylinders 50 and 52 move the material into compression chambers 46 and 48 where the material is compressed to the final density, with flat top and bottom surfaces and convex side surfaces. Finally, ejection cylinders 58 eject the packages to the wrapping station 62, as seen in FIG. 10.

Figure 10:
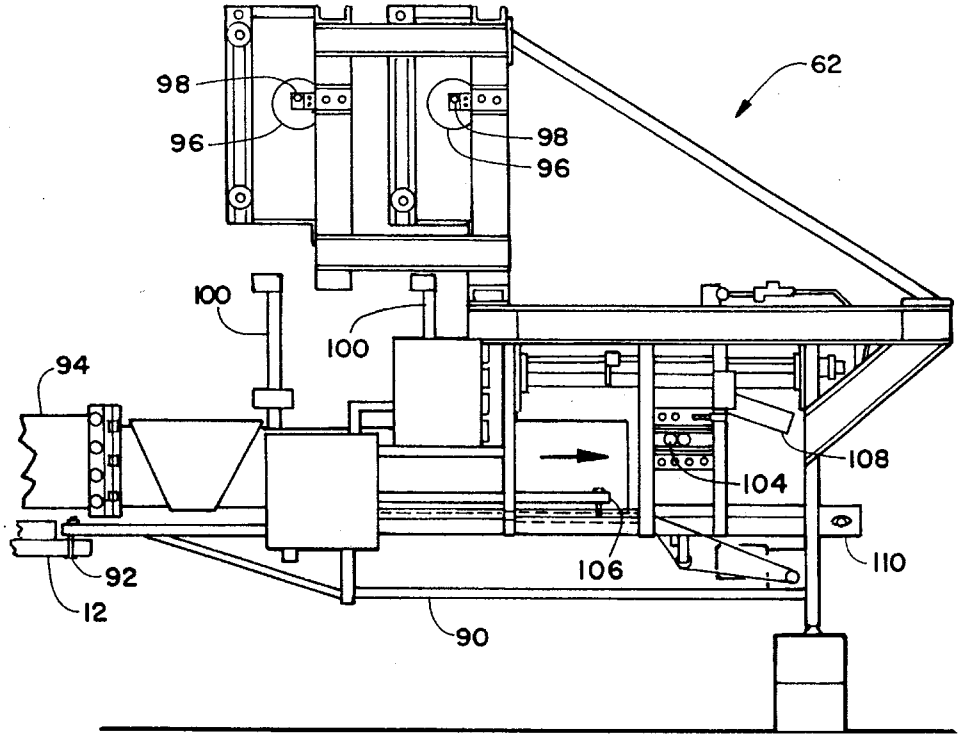
FIG. 10 is a side elevation view of the wrapping mechanism.

FIG. 10 provides details of a preferred material package wrapping station 62. While packages may be handled in an unwrapped condition, wrapping them in a tight plastic film is preferred. A schematic flow diagram is provided in FIG. 11 to clarify the film path from supply rollers 96 to the film former 102. Any other suitable, conventional, wrapping arrangement may be used, if desired. This station is supported on a platform 90 extending from the side of base 12, secured thereto by pin 92. Two expansion regulator tubes 94 are connected to the eject cylinders 58 as seen in FIG. 5. Undesired expansion of the compressed material is prevented by tubes 94.

Figure 11:
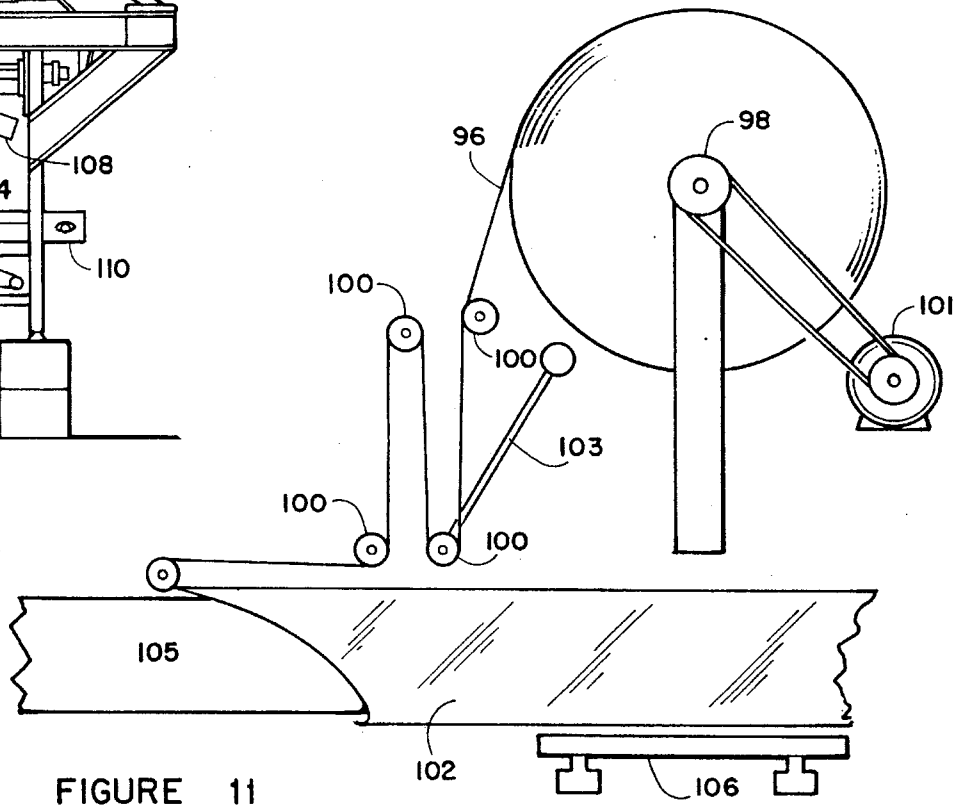
FIG. 11 is a schematic elevation view illustrating the operation of the wrapping mechanism of FIG. 10.

As most clearly seen in FIG. 11, heat sealable plastic film 97 from rollers 98 passes around film feed rollers 100 to two film formers 102. Drive motor 101 continuously rotates roller 98. Bar 103 is pivoted at the top so that it can swing to accommodate the slight pause in film motion at the tube former when succeeding packages are formed, with continuous feed from roller 98. The floating lower roller 100 on bar 103 is free to float to take up the slack during cutting. Film 100 at former 102 is wrapped around a mandrel to form a tube with overlapping lower edges. These edges are heat sealed to form a continuous tube by heated bottom seal bar 106. Packages of material enter through conduit 105 from the compression chamber station described above and are pushed into the tube as the tube is formed. The tube is cut between packages, the ends of the tube are folded and heat sealed by side seal bars 104. Preferably, the ends of the tube are vibrated by a conventional vibrating means to cause dust to slide back toward the package of material in the tube, to avoid contaminating the sealing surfaces. This cutting and sealing operation may be conducted in a manner similar to that described in James U.S. Pat. No. 4,288,965, the disclosure of which is hereby incorporated by reference. Handles may be applied to the package by any conventional method, such as heat sealing sheet plastic handles to the finished package. Alternately, bars carrying outwardly extending knives may be brought against the packages so that handholds are cut into the packages by the knives.

While certain preferred materials, dimensions and arrangements have been described in detail in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

I claim:

1. Apparatus for packaging fibrous material which comprises:

means for receiving fibrous material in the form of bales having bands therearound;

means for cutting and removing said bands comprising knife blades for cutting said bands along the lower side of said bales as said bales move thereover, pickup rods for engaging the upper surface of said bales and lifting said bands and cooperating closely spaced endless belts for carrying said bands away from said bales;

conveyor means for moving a stream of said fibrous material from said band removal means;

leveling means for maintaining a substantially uniform depth of said fibrous material on said conveyor;

measuring means for separating a selected quantity of said fibrous material from said stream;

compression means for compressing said selected quantity into a shape retaining package having selected density; and enclosing means for enclosing said package in a plastic film cover.

2. The apparatus according to claim 1 further including means for cutting and milling said fibrous materials to a selected size distribution.

3. The apparatus according to claim 1 wherein said leveling means comprises an endless belt spaced a selected distance from said conveyor carrying said fibrous material, said endless belt having a plurality of transverse cleats on the surface thereof and said belt being rotatable in the opposite direction of said conveyor direction.

4. The apparatus according to claim 1 wherein said measuring means comprises at least one scale for receiving said fibrous material and means for dumping material from said scale into at least one load chamber for directing said material to said compression means when a predetermined quantity has accumulated thereon.

5. The apparatus according to claim 1 further including means for distributing a beneficial additive to the fibrous material after the fibrous has been leveled prior to entering a weighing station.

6. The apparatus according to claim 1 wherein said fibrous material is reduced in volume from about 10:1 to 30:1.

7. The apparatus according to claim 2 wherein said means for cutting said fibrous material comprises an eggcrate style cutter having a plurality of cutter blades in two sets intersecting at approximately right angles, means for forcing said fibrous material through said cutter blades and means for vibrating said cutter blades.

8. The apparatus according to claim 2 further including a tub milling means for milling said fibrous material prior to measuring said material.

9. The apparatus according to claim 7 wherein said cutter blades in each set are spaced about 2 to 4 inches apart.

10. The apparatus according to claim 3 further including means for varying the spacing between said conveyor and the closest approach thereto of said cleats.

11. The apparatus according to claim 4 wherein two load chamber means are provided and said scale is a suspended platform scale for alternately dumping selected quantities of material into said at least one load chamber.

12. A machine for packaging fibrous material which comprises:

means for receiving baled fibrous material;

separation means for cutting and removing binding bands from said bales comprising knife blades for cutting said bands along the lower side of said bales as said bales move thereover, pickup rods for engaging the upper surface of said bales and lifting said bands and cooperating closely spaced endless belts for carrying said bands away from said bales;

cutting means for cutting said bales into substantially uniform portions;

means for forming a continuous moving stream of said material having substantially uniform selected depth, milling means for milling said fibrous materials to a selected size distribution;

means for weighing and separating selected quantities of said fibrous material from said stream and directing said quantities to load chambers;

compression means for receiving said quantities from said load chambers and for highly compressing said selected quantity into a shape retaining package; and packaging means for enclosing said package in a plastic film enclosure.

13. The apparatus according to claim 12 wherein said means for cutting said fibrous material comprises an eggcrate style cutter having a plurality of cutter blades in two sets intersecting at approximately right angles, means for forcing said fibrous material through said cutter blades and means for vibrating said cutter blades.

14. The apparatus according to claim 12 further including a tub milling means for milling said fibrous material prior to measuring said material.

15. The apparatus according to claim 12 wherein said leveling means comprises an endless belt spaced a selected distance from said conveyor carrying said fibrous material, said endless belt having a plurality of transverse cleats on the surface thereof and said belt being rotatable in the opposite direction of said conveyor direction.

16. The apparatus according to claim 12 wherein two load chamber means are provided and said scale is a suspended platform scale for alternately dumping selected quantities of material into each load chamber.

17. The apparatus according to claim 12 further including means for distributing a beneficial additive to the fibrous material after the fibrous has been leveled prior to entering the weighing station.

18. The apparatus according to claim 12 wherein said fibrous material is reduced in volume from about 10:1 to 30:1.

19. The apparatus according to claim 13 wherein said cutter blades in each set are spaced about 2 to 4 inches apart.

20. The apparatus according to claim 15 further including means for varying the spacing between said conveyor and the closest approach thereto of said cleats.

* * * * *